US008763496B2

(12) United States Patent
Case et al.

(10) Patent No.: US 8,763,496 B2
(45) Date of Patent: Jul. 1, 2014

(54) METHOD AND APPARATUS FOR INSTALLATION AND REMOVAL OF A VALVE COVER

(75) Inventors: Larry Don Case, McAlester, OK (US); Jason Neal Whaley, Hartshorne, OK (US); Randall Ferrain Weaver, McAlester, OK (US)

(73) Assignee: National Oilwell Varco, L.P., Houston, TX (US)

( * ) Notice: Subject to any disclaimer, the term of this patent is extended or adjusted under 35 U.S.C. 154(b) by 462 days.

(21) Appl. No.: 13/112,814

(22) Filed: May 20, 2011

(65) Prior Publication Data

US 2011/0283537 A1 Nov. 24, 2011

Related U.S. Application Data

(60) Provisional application No. 61/347,183, filed on May 21, 2010.

(51) Int. Cl.
*B25B 13/06* (2006.01)
*B25B 21/00* (2006.01)
*B25B 23/00* (2006.01)

(52) U.S. Cl.
CPC ..... *B25B 21/005* (2013.01); *B25B 23/0078* (2013.01)
USPC ..... 81/57.39; 29/890.124

(58) Field of Classification Search
USPC ..... 81/57.39, 57.44, 176.2, 180.1, 124.3; 29/890.124
See application file for complete search history.

(56) References Cited

U.S. PATENT DOCUMENTS

| | | | | |
|---|---|---|---|---|
| 4,027,561 | A | 6/1977 | Junkers | |
| 4,086,830 | A | 5/1978 | Latham | |
| 4,269,088 | A * | 5/1981 | Dukes | 81/57.39 |
| 4,782,858 | A | 11/1988 | Fujiwara | |
| 4,919,018 | A * | 4/1990 | Beuke | 81/57.39 |
| 5,097,730 | A * | 3/1992 | Bernard et al. | 81/57.39 |
| 5,992,272 | A | 11/1999 | Fortner | |
| 6,279,427 | B1 * | 8/2001 | Francis | 81/57.39 |
| 6,289,770 | B1 * | 9/2001 | Collins | 81/57.39 |
| 2006/0029502 | A1 | 2/2006 | Kugelev et al. | |
| 2010/0054974 | A1 | 3/2010 | Riley et al. | |
| 2011/0203419 | A1 * | 8/2011 | Riestra | 81/57.39 |

FOREIGN PATENT DOCUMENTS

| | | |
|---|---|---|
| EP | 2063062 A1 | 5/2009 |
| JP | 2004519584 | 7/2004 |
| WO | 02081911 | 10/2002 |

OTHER PUBLICATIONS

PCT/US2009/055185 International Search Report and Written Opinion, Feb. 4, 2010 (8 p.).
P-Quip Ltd. ; Kwik-Cover; Mud Pump Valve Covers; (2 p.).

(Continued)

*Primary Examiner* — David B Thomas
(74) *Attorney, Agent, or Firm* — Conley Rose, P.C.

(57) ABSTRACT

Apparatus and methods for removing valve cover components includes a torque transfer tool that mates with an extending portion of the valve cover assembly and has a multi-faceted segment to receive a torque-supplying wrench. A hydraulically-actuated wrench has a head with a multi-faceted portion that engages the corresponding multi-faceted segment of the torque transfer tool. The wrench's hydraulic cylinder rotates the wrench head upon actuation. The multi-faceted segments can be splined. Also disclosed is a reaction tube against which the wrench can be braced prior to actuation of the cylinder.

20 Claims, 7 Drawing Sheets

(56) References Cited

OTHER PUBLICATIONS

P-Quip Ltd.; Instructions for the Safe Use of P-Quip Valve Cover Retention Systems—Pt. No. 12000000; (Rev. Date: Dec. 19, 2007); (6 p.).
P-Quip Ltd.; Instructions for the Safe Use of P-Quip Valve Cover Retention Systems—Pt. No. 14000001; (Rev. Date: Jan. 27, 2009); (6 p.).
P-Quip Ltd.; Instructions for the Safe Use of P-Quip Valve Cover Retention Systems—Pt. No. 16000001; (Rev. Date: Dec. 19, 2007); (6 p.).
P-Quip Ltd.; Instructions for the Safe Use of P-Quip Valve Cover Retention Systems—Pt. No. 16000002; (Rev. Date: Dec. 19, 2007); (6 p.).
P-Quip Ltd.; Instructions for the Safe Use of P-Quip Valve Cover Retention Systems—Pt. No. 17000002; (Rev. Date: Aug. 21, 2003); (5 p.).
P-Quip Ltd.; Instructions for the Safe Use of P-Quip Valve Cover Retention Systems—Pt. No. 17000005; (Rev. Date: Aug. 21, 2003); (5 p.).
P-Quip Ltd.; Instructions for the Safe Use of P-Quip Valve Cover Retention Systems—Pt. No. 18000000; (Rev. Date: Dec. 19, 2007); (6 p.).
P-Quip Ltd.; Instructions for the Safe Use of P-Quip Valve Cover Retention Systems—Pt. No. 20000008; (Rev. Date: -Aug. 12, 2008); (6 p.).
P-Quip Ltd.; Instructions for the Safe Use of P-Quip Valve Cover Retention Systems—Pt. No. 2100000; (Rev. Date: Oct. 29, 2004); (5 p.).
P-Quip Ltd.; Instructions for the Safe Use of P-Quip Valve Cover Retention Systems—Pt. No. 22000003; (Rev. Date: Aug. 21, 2003); (6 p.).
P-Quip Ltd.; Instructions for the Safe Use of P-Quip Valve Cover Retention Systems—Pt. No. 22000004; (Rev. Date: Aug. 21, 2003); (6 p.).
P-Quip Ltd.; Instructions for the Safe Use of P-Quip Valve Cover Retention Systems—Pt. No. 22000005; (Rev. Date: Oct. 04, 2005); (6 p.).
P-Quip Ltd.; Instructions for the Safe Use of P-Quip Valve Cover Retention Systems—Pt. No. 23000001; (Rev. Date: Jul. 25, 2007); (5 p.).
PCT/US2011/037402 International Search Report and Written Opinion dated Feb. 29, 2012 (9 p.).

* cited by examiner

METHOD AND APPARATUS FOR INSTALLATION AND REMOVAL OF A VALVE COVER

CROSS-REFERENCE TO RELATED APPLICATIONS

This application claims benefit of U.S. provisional patent application Ser. No. 61/347,183 filed May 21, 2010, and entitled "Method and Apparatus for Installation and Removal of a Valve Cover," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to pumps, and more particularly, to the suction and discharge valves of reciprocating pumps. Still, more particularly, the invention relates to apparatus and methods that enable access to suction and discharge valves of reciprocating pumps and closure of chambers which contain them.

2. Background of the Technology

Reciprocating pumps are used in various applications. For example, reciprocating pumps are often used in drilling operations to pressurize a slurry mixture of solids and liquids known as drilling mud, which is then conveyed to the bottom of a borehole drilled in the earth. The pressurized mud is used to maintain appropriate borehole pressure, lubricate and cool a downhole drill bit, and carry loosened sediment and rock cuttings from the borehole bottom to the surface. At the surface, the cuttings and sediment are removed from the returning drilling mud, and the filtered drilling mud may be recycled and pumped back to the borehole bottom.

Suction and discharge valves are used in reciprocating pumps to control the flow of fluid into and out of the pump's cylinders where the fluid is pressurized. Due to the highly abrasive nature of the particles often present in the fluid, the valves and seals of the pumps must be designed to resist harsh abrasion, while maintaining positive sealing action under relatively high operating pressures. Even so, the valves have a finite service life, and ultimately must be replaced due to deterioration of the elastomeric sealing element of the valve, deterioration caused by erosion of the mating metal contact surfaces of the valve and valve seat, or combinations thereof. When leakage through the valves is sufficient to render the pump unable to maintain satisfactory fluid pressure for the drilling conditions, the valves must be replaced.

Maintenance of these valves is a time consuming and difficult process that presents risks of injuries to service personnel. To service most conventional valves, the valve cover is removed. In some pumps, a threaded ring acts as a valve cover retainer to hold the valve cover in place. This valve cover retainer may have through-holes that allow a pipe to be inserted and used as a lever arm to facilitate rotation and removal of the retainer and, subsequently, removal of the valve cover held by the retainer. Sometimes, a heavy sledge hammer must be used against the lever arm to loosen the valve cover retainer. Once loosened the mechanic must then unscrew and disengage the relatively long length of threads between the valve cover retainer and its seat. Furthermore, the maintenance of most conventional valves is often costly since the pump must be shut down during such maintenance procedures, thereby interrupting the drilling activity. Accordingly, there remains a need to develop apparatus and methods for safely and quickly providing access to suction and discharge valves of reciprocating pumps.

BRIEF SUMMARY OF THE DISCLOSURE

An apparatus for removing components of a valve cover assembly is shown to include a first tool having a generally cylindrical body adapted to mate with an extending portion of the valve cover assembly and a multi-faceted segment on the body adapted to receive a torque-supplying wrench; a pair of aligned holes in the body that align with throughbores in the extending portion of the valve cover assembly; and a first pin member disposed through the aligned holes of the body and through the transverse throughbores in the valve cover assembly.

The removal apparatus may also include a wrench having an arm and a wrench head coupled thereto that is adapted for rotation with respect to the arm, the head including a multi-faceted portion for engaging a corresponding multi-faceted segment of the first tool; and a hydraulic cylinder coupled between the head and the arm and adapted to rotate the wrench head upon actuation of the cylinder.

The removal apparatus may further include a reaction tube. The reaction tube includes a generally cylindrical body adapted to mate with the extending portion of another, adjacent valve cover assembly. The reaction tube body includes a pair of aligned holes that align with the throughbores in the extending portion of the adjacent valve cover assembly. A pin is disposed through the aligned holes.

In some embodiments, the multi-faceted segments on the tool and the wrench are splined segments that interlockingly engage. Further, in some embodiments, the wrench includes an arcuate rail portion extending radially outward from the head and having a generally T-shaped cross-section that is slidingly received in a corresponding arcuate slot in the arm.

Also disclosed is a method of installing or removing components of a valve cover assembly. The method includes pinning to a valve cover component a torque transfer tool that includes a male tool-engaging, multi-faceted section, placing a female multi-faceted, tool-engaging section of a wrench onto the male multi-faceted, tool-engaging section of the torque transfer tool, placing the arm of the wrench against a support; and actuating the wrench's hydraulic cylinder to cause the arm of the wrench to act against the support and apply rotational torque to the torque transfer tool.

A wrench is also disclosed having an elongate arm with a head that is rotatably coupled to the arm. The head includes an arcuate segment having an arcuate length less than 360 degrees and, optionally, not greater than 180 degrees, and having at least one protrusion extending radially inwardly for engagement with a receiving bore. The wrench further includes a hydraulic cylinder coupled to the head and to the arm, the cylinder being adapted to rotate the head upon actuation.

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the disclosed embodiments of the invention, reference will now be made to the accompanying drawings in which.

DETAILED DESCRIPTION OF THE DISCLOSED EMBODIMENTS

Figure 1:
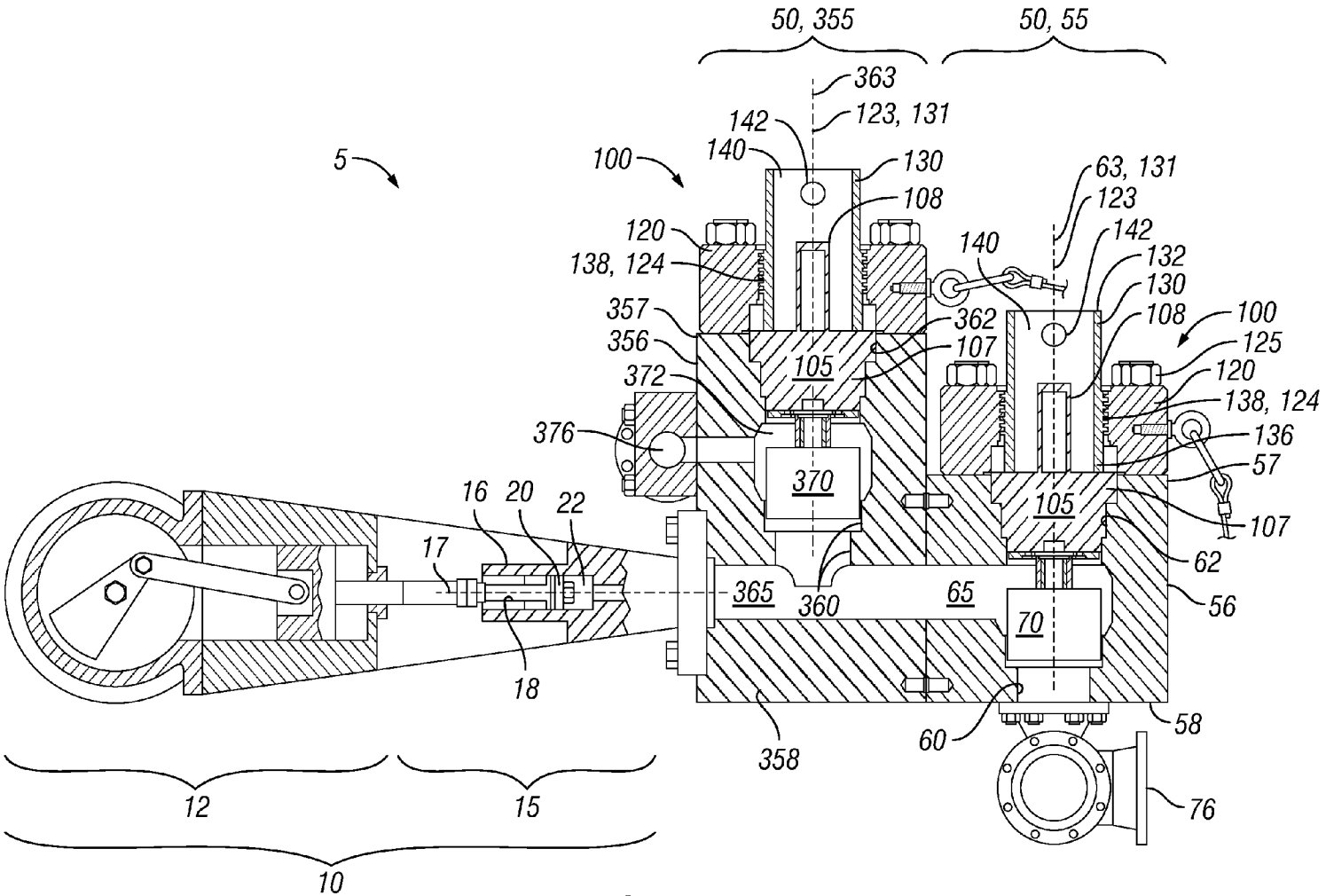
FIG. 1 is a cross-sectional elevation view of a reciprocating pump capable of being serviced using the methods and apparatus disclosed herein. The view corresponds to cross-section Y-Y defined in FIG. 2.

The following discussion is directed to various embodiments of the invention. The embodiments disclosed should not be interpreted or otherwise used as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used in the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in interest of clarity and conciseness. In addition, like or identical reference numerals may be used to identify common or similar elements.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples or is coupled to a second device, that connection may be through a direct connection, or through an indirect connection via other devices, components, and connections. In addition, as used herein, the terms "axial" and "axially" generally mean along or parallel to a given axis (e.g., central axis of a body or a port), while the terms "radial" and "radially" generally mean perpendicular to the axis. For instance, an axial distance refers to a distance measured along or parallel to the axis, and a radial distance means a distance measured perpendicular to the axis.

FIG. 1 shows an embodiment of a reciprocating pump 5 for pumping a fluid (e.g., drilling mud). Reciprocating pump 5 includes a piston-cylinder assembly 10 coupled with two flow control modules 50. One control module 50 is configured as a fluid suction or inlet module 55, and the other is configured as a fluid discharge or outlet module 355. On pump 5, as shown in FIG. 1, the discharge module 355 is positioned between the piston-cylinder assembly 10 and the suction module 55; although, in general, the relative positions of discharge module 355 and the suction module 55 could be different.

Piston-cylinder assembly 10 includes a fluid section 15 proximal outlet module 355 and a power transfer section 12 distal outlet module 355. Fluid section 15 includes a cylinder 16 and a piston 20. Cylinder 16 has a central axis 17 and a through bore 18. Piston 20 is coaxially disposed within bore 18 and slidingly engages the inner surface of cylinder 16. Piston 20 and cylinder 16 define a variable-volume chamber 22.

Referring still to FIG. 1, fluid suction module 55 comprises a housing block 56, a fluid chamber or passage 65, a suction valve 70, and a valve cover assembly 100, described in more detail below. Housing block 56 has an upper end 57, a lower end 58, a fluid entry bore 60, and a valve access bore 62. Valve access bore 62 has a vertical central axis 63. Fluid entry bore 60 extends vertically upward from lower end 58 to centrally located fluid chamber 65, and valve access bore 62 extends vertically downward from upper end 57 to fluid chamber 65. Suction valve 70 is slidingly disposed within fluid entry bore 60 and extends into fluid chamber 65. As will be described in more detail below, suction valve 70 regulates the flow of fluid between a fluid supply 76, which is coupled to suction module 55, and fluid chamber 65. Valve cover assembly 100 couples to upper end 57 of housing block 56 and extends into valve access bore 62. Valve cover assembly 100 retains suction valve 70.

Fluid discharge module 355 comprises a housing block 356, a fluid chamber or passage 365, an outlet chamber 372, and a discharge valve 370, and a valve cover assembly 100. The valve cover assembly 100 coupled with discharge module 355 is substantially the same as the valve cover assembly 100 of suction module 55. Housing block 356 has an upper end 357, a lower end 358, a fluid outlet bore 360, and a valve access bore 362. Valve access bore 362 has a vertical central axis 363. Fluid outlet bore 360 extends vertically upward from fluid chamber 365 to the bottom of outlet chamber 372. Valve access bore 362 extends vertically downward from upper end 357 to the top of outlet chamber 372. A fluid outlet 376 is in fluid communication with internally disposed outlet chamber 372. Discharge valve 370 is slidingly disposed within fluid outlet bore 360 and extends into outlet chamber 372. Discharge valve 370 regulates the flow of fluid between chamber 365 and outlet chamber 372, leading to fluid outlet 376. Valve cover assembly 100 couples to upper end 357 of housing block 356 and extends into valve access bore 362. Valve cover assembly 100 retains discharge valve 370.

Referring still to FIG. 1, each flow control module 50 (i.e. suction module 55, discharge module 355) includes a valve cover assembly 100 as stated earlier. The coupling and functionality of each valve cover assembly 100 are substantially the same for fluid discharge module 355 as for suction module 55. Therefore, for brevity, valve cover assembly 100 will be described with reference to suction module 55, it being understood that the interrelationship between an assembly 100 and discharge module 355 is the same as between an assembly 100 and suction module 55.

As shown in FIG. 1, valve cover assembly 100 comprises a valve cover 105, an annular flange 120, and a tubular valve cover retainer 130. Flange 120 has a central axis 123 and an internally threaded through-bore 124. Valve cover retainer 130 is a generally tubular member having a central axis 131, a first or upper end 132, and a second or lower end 136 opposite the upper end. Retainer 130 is axially aligned with flange 120. Starting at lower end 136 and extending upward, external threads 138 cover a segment of the outer surface of the valve cover retainer 130. External threads 138 are rotationally mated with the internally threaded through-bore 124 of flange 120. Retainer 130 includes a through-hole 140 extending axially downward from upper end 132 and a plurality of radially-aligned through-holes 142 near the upper end 132. In this embodiment, there are four through-holes 142 uniformly spaced around the circumference of retainer 130 and spaced at an equal axial distance from upper end 132; however, other spacings and numbers of holes may be employed. Valve cover 105 has a generally cylindrical body 107 and a handle 108 extending upward.

Flange 120 of valve cover assembly 100 is coupled to the upper end 57 of suction module housing block 56. Flange central axis 123 and retainer central axis 131 are aligned with central axis 63 of valve access bore 62. The flange 120 is rigidly affixed to housing block upper end 57. The coupling of flange 120 to upper end 57 may be accomplished by threaded fasteners 125 such as nuts that are attached to threaded studs, or by other suitable means. With this arrangement, valve cover 105 is disposed in valve access bore 62 and held by cover retainer 130 after it is threaded into flange 120 and tightened. Valve cover 105, in turn, retains pump suction valve 70 and can restrict fluid flow through access bore 62. As will be described in more detail below, retainer 130 and valve cover 105 are removable to permit access to valve 70 via access bore 62 for installation, repair, service, and/or replacement operations. Although valve cover assembly 100 is mounted to upper end 57 in this embodiment, in other embodiments the valve cover assembly 100 may be mounted to another suitable location. Upper end 132 of tubular valve cover retainer 130 extends above flange 120 and above fasteners 125. Radially aligned holes 142 in retainer 130 are disposed at axial locations above flange 120 and above fasteners 125.

Referring still to FIG. 1, the operation of pump 5 is described with reference to both fluid suction module 55 and fluid discharge module 355. In pump 5, fluid chambers 65, 365 are in fluid communication with each other and with chamber 22 of piston-cylinder assembly 10. Valves 70, 370 are also in fluid communication with fluid chamber 22, via fluid chambers 65, 365. Each valve 70, 370 is configured to allow fluid flow in only one direction. In particular, suction valve 70 allows fluid to flow from fluid supply 76, through fluid entry bore 60, and into flow fluid chamber 65. As a result, the fluid also can enter the coupled fluid chambers 365, 22. Suction valve 70 prevents fluid in chamber 65 from returning to fluid supply 76. In a complementary manner, discharge valve 370 allows fluid from fluid chambers 22, 65, 365 to flow through fluid outlet bore 360 and to outlet chamber 372 and fluid outlet 376. Discharge valve 370 prevents fluid in outlet chamber 372 from returning to chamber 365.

During operation of pump 5, piston 20 reciprocates within cylinder 16, alternately increasing and decreasing the volume of chamber 22. When the volume of chamber 22 increases, a vacuum develops in fluid chambers 22, 65, 365. That is to say the fluid pressure in chambers 22, 65, 365 reduces to less than the fluid pressure in fluid supply 76 and less than the fluid pressure in outlet chamber 372. The vacuum lifts and separates suction valve 70 from the surfaces of fluid entry bore 60. With suction valve 70 lifted, fluid from fluid supply 76 is drawn through entry bore 60 and into chamber 65. The same inward pressure differential created by the vacuum also pulls discharge valve 370. However, due to the design of discharge module 355, the vacuum compels discharge valve 370 to remain sealed against the surfaces of fluid outlet bore 360 and thus prevents the entry of fluid from outlet chamber 372. When piston 20 moves in the opposite direction, the volume of chamber 22 decreases. As a result, fluid pressure increases in flow passages 65, 365, compelling suction valve 70 to seal against the surfaces of fluid entry bore 60 and thereby prevent fluid from exiting through fluid supply 76. At the same time, the pressure in flow passage 365 pushes discharge valve 370 upward, away from the surfaces of fluid outlet bore 360, allowing fluid to exit from fluid chamber 365 into outlet chamber 372 and fluid outlet 376.

Pump Valve Maintenance

Figure 2:
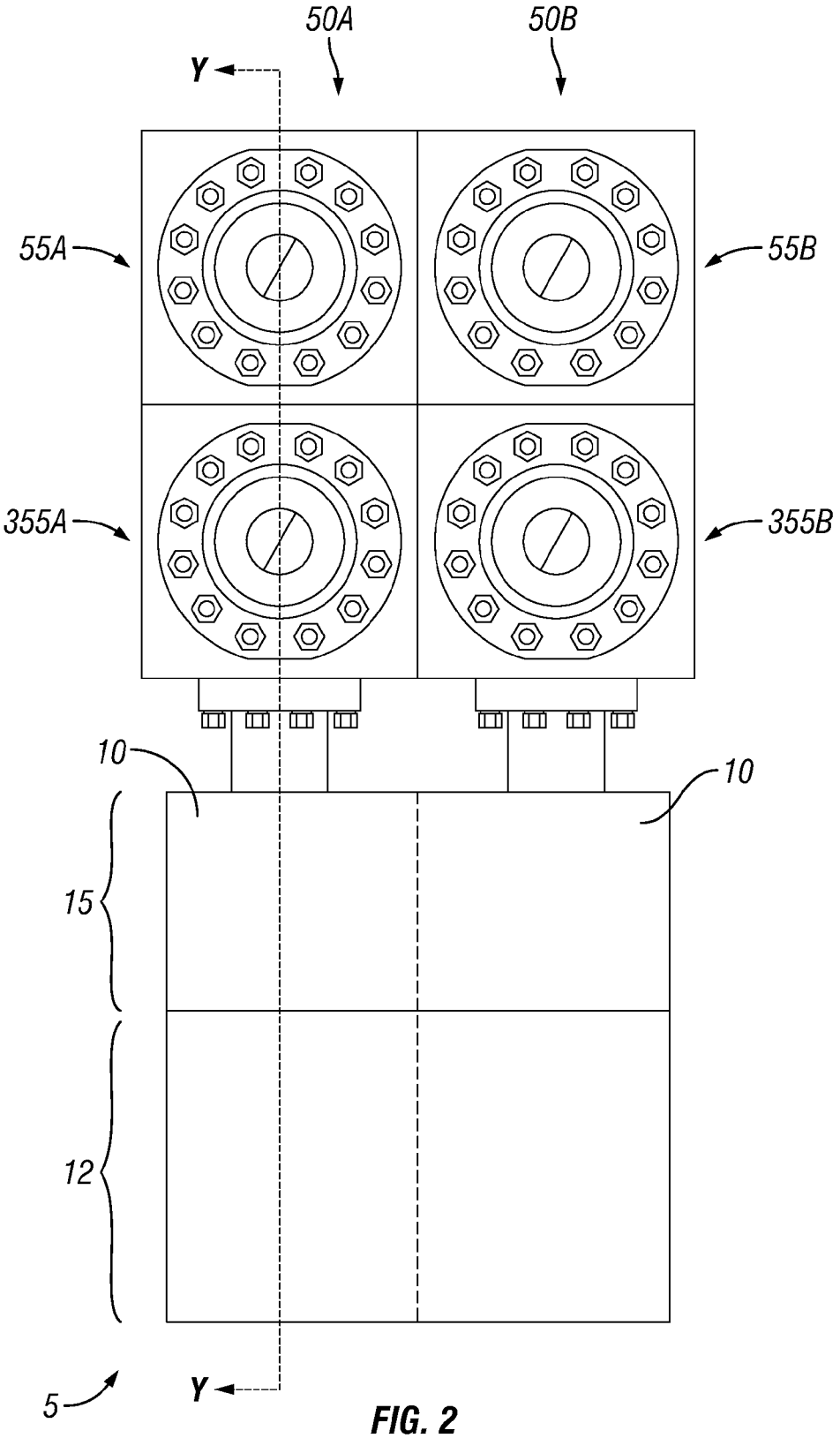
FIG. 2 is a plan view, partially in schematic form, of the reciprocating pump shown in FIG. 1.

The installation and removal of a valve cover retainer 130 and valve cover 105 is first described with reference to FIG. 2, which shows a top view of a pump 5 that has two piston-cylinder assemblies 10. Each piston-cylinder assembly 10 requires a pair of flow control modules 50, consisting of one suction module 55 and one discharge module 355. Hence, in FIG. 2, a total of two suction modules 55 and two discharge modules 355 are coupled to fluid section 15 of pump 5, equating to two pair of flow control modules 50. For clarity, reference numerals for items pertaining to the fluid control modules 50 on one side will include the label "A" while reference numerals for items pertaining to the modules on the other side will include the label "B." Although FIG. 2 depicts only two pair of neighboring flow control modules 50, in general, any number of pairs of flow control modules 50 may be installed on a reciprocating pump, corresponding to the number of piston-cylinder assemblies 10. Thus, it is to be understood that the present disclosure applies to pumps having any number of piston-cylinder assemblies 10 and flow control modules and applies to pumps that have combined suction and discharge modules.

Figure 3:
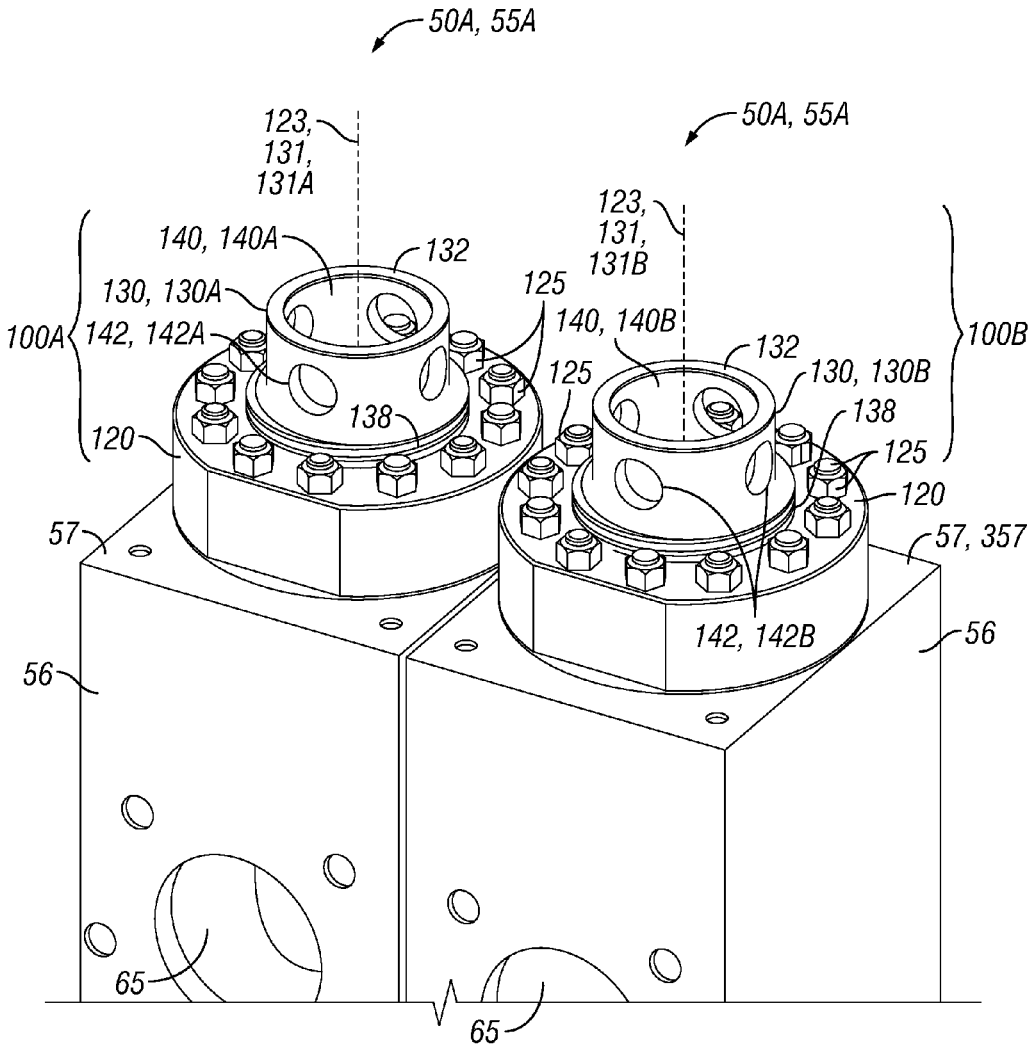
FIG. 3 is a perspective view of two fluid control modules of the reciprocating pump shown in FIG. 2. The modules include valve cover assemblies.

Referring now to FIG. 3, two flow control modules 50 for reciprocating pumps are shown. In this exemplary embodiment, the individual modules 50 are suction modules 55A, 55B as described above with reference to FIG. 2. Pump 5 is configured such that suction modules 55 extend to a height that is different than the height of discharge modules 355 as shown in FIG. 1. In other pumps, the upper end of discharge modules 355 may extend to the same height as the upper end of the suction modules 55.

Referring again to FIG. 1, for each flow control module 50, a valve cover assembly 100 provides access to a suction valve 70 or a discharge valve 370 to allow inspection or maintenance. When maintenance or inspection is required for either valve 70 or 370, the appropriate valve cover retainer 130 and valve cover 105 must be removed to permit access, and later must be installed again prior to operation of the pump. To facilitate this removal and installation, methods and an apparatus described herein have been developed.

Figure 4:
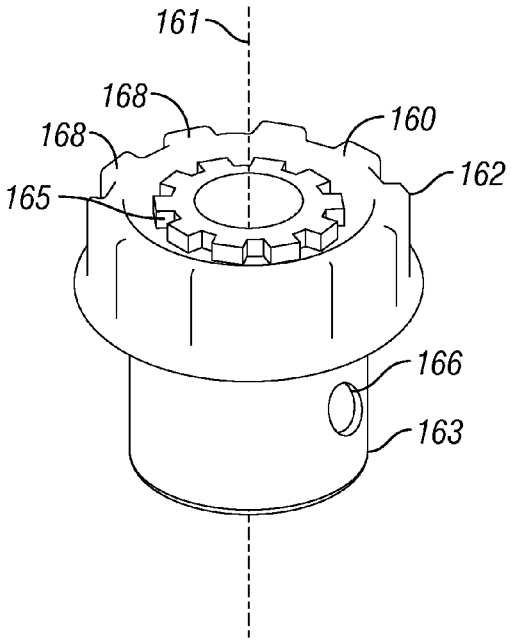
FIG. 4 is a perspective view of a torque transfer tool disclosed herein for removing and installing components of a valve cover assembly.
Figure 5:
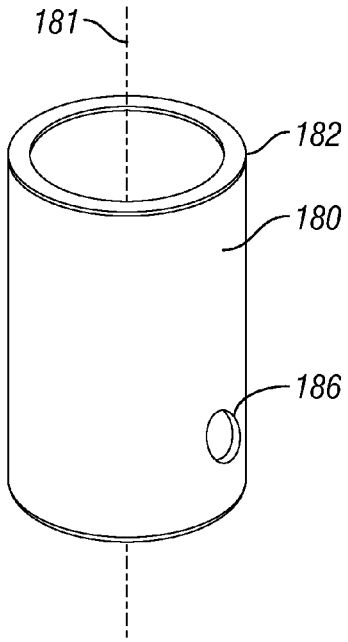
FIG. 5 is a perspective view of a reaction tube disclosed herein for removing and installing components of a valve cover assembly.
Figure 6:
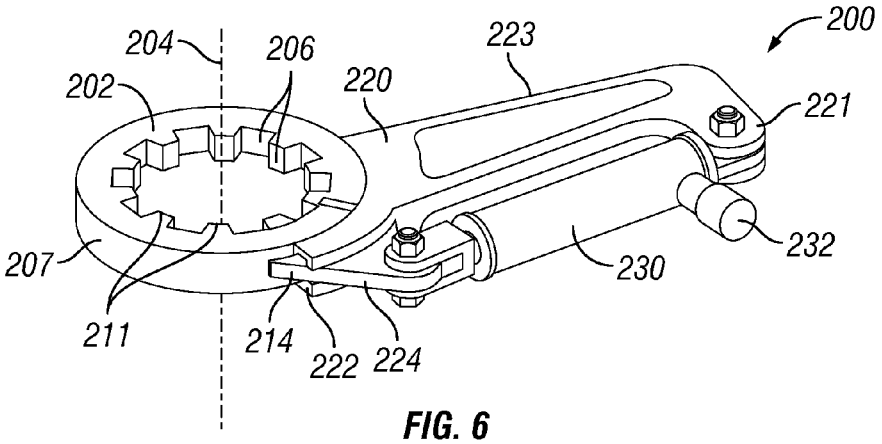
FIG. 6 is a perspective view of a wrench disclosed herein for removing and installing components of a valve cover assembly.

Referring now to FIGS. 4, 5, and 6, in a first embodiment, a valve cover access apparatus 150 (FIG. 8) comprises three primary components: a torque transfer tool 160, a reaction tube 180, and a wrench 200. As shown in FIG. 4, torque transfer tool 160 is generally cylindrical in shape with a central axis 161, a first or upper end 162, and a second or lower end 163. The larger, upper end 162 has external, radially and axially-extending splines or teeth 168 spaced around its circumference. External splines 168 are also called male splines. The smaller diameter, lower end 163 is a cylinder with a plurality of radially aligned, through-holes 166. The generally cylindrical form of lower end 163 may be solid or may be hollow, i.e. tubular. In the embodiment of FIG. 4, lower end 163 includes one pair of aligned through-holes 166, but it may include a greater number of holes 166. The lower end 163 of torque transfer tool 160 slidingly mates within through-hole 140 of valve cover retainer 130. Through-holes 166 are circumferentially spaced and axially positioned to align with the through-holes 142 in a valve cover retainer 130 when the lower end 163 of torque transfer tool 160 is fully seated within a valve cover retainer 130 as described in more detail below.

In the exemplary embodiment shown in FIG. 4, upper end 162 and lower end 163 are fabricated as two separate cast members, interlockable by a complementary spline pair 165. Thus, upper end 162 and lower end 163 are designed to be press-fit together to form torque transfer tool 180. Torque transfer tool 180 can be fabricated with other designs and other methods. Spline pair 165 is distinct from external splines 168. As will be explained later, external splines 168 engage with a removable wrench during pump maintenance.

Referring to FIG. 5, reaction tube 180 is a generally tubular member formed about a central axis 181, and having a first or upper end 182, and a second or lower end 183. The lower end 183 contains a plurality of radially-extending through-holes 186. In the embodiment of FIG. 5, lower end 183 includes one pair of aligned through-holes 186, but it may include a greater number of holes 186. Reaction tube 180 slidingly mates within through-hole 140 of a valve cover retainer 130. (See FIGS. 3 and 7.) Through-holes 186 are circumferentially-spaced and axially positioned to align with the through-holes 142 in valve cover retainer 130 when reaction tube 180 is seated within valve cover retainer 130 as described below.

Wrench 200, best shown in FIG. 6, has a captive, annular head 202 that functions like a mechanic's socket, a reaction arm 220, a rotatable arm 224, and a hydraulic cylinder 230. Annular head 202 includes a central axis 204 and an inner surface 206, an outer, generally cylindrical surface 207, and internal, evenly-spaced, radially and axially extending splines or teeth 211 circumferentially-disposed about the inner surface 206 of annular head 202. Internal splines 211 are also called female splines. Annular head 202 also includes an arcuate rail 214 with a generally T-shaped cross-section. T-shaped rail 214 extends radially outward from outer surface 207 and wraps around a portion of its circumference. Rotatable arm 224 also extends radially outward from the circumference of annular head 202 and may be separate from or integrated with a portion of T-shaped rail 214. T-shaped rail 214 slidingly engages the inner surface of an arcuate T-slot 222 in reaction arm 220. Reaction arm 220 further includes bearing surface 223 and a bracket 221 that is coupled to one end of hydraulic cylinder 230 and adapted to allow rotational or pivoting movement there between. Hydraulic cylinder 230 is connected between bracket 221 and rotatable arm 224. One or more hydraulic fittings 232 are provided to couple hydraulic cylinder 230 to a supply path and a return path for pressurized fluid (not shown). When hydraulic pressure is applied, hydraulic cylinder 230 extends, causing the rotatable arm 224 and coupled annular head 202 to rotate relative to bracket 221 and arm 220. In the disclosed embodiment, hydraulic cylinder 230 has an internal spring (not shown) that forces the cylinder to retract when hydraulic pressure is released. Therefore, hydraulic fluid is both supplied and returned through one hydraulic fittings 232.

Although in this embodiment, annular head 202 and reaction arm 220 are coupled by rail 214 with a T-shaped cross-section slidingly engaging with a corresponding T-slot 222, another interlinkable, slidingly engagable coupling having a different cross-section could be used. For example, the cross-section might be L-shaped or the shape of a truncated triangle. That is, rail 214 is configured to have a cross-sectioned profile that changes in shape in the direction radially outward from outer surface 207. Arcuate slot 222 is formed to have a corresponding shape. The irregular, changing cross-sectional profile allows the slot 222 to capture and retain rail 214.

Figure 7:
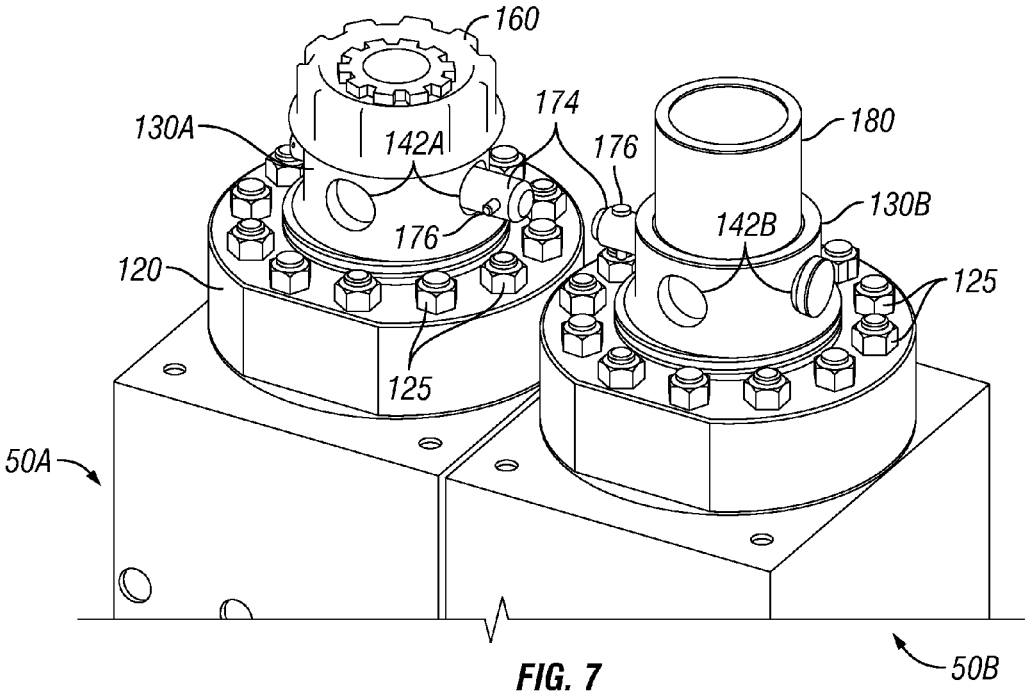
FIG. 7 is a perspective view of two fluid control modules of a reciprocating pump with a valve cover assembly being prepared for access in accordance with principles disclosed herein.

Referring now to FIG. 7, valve cover retainer 130A is shown ready for removal. Torque transfer tool 160 is axially aligned and inserted within retainer 130A. A pair of horizontal through-holes 166 (FIG. 4) in tool 160 are axially aligned with a pair of holes 142A in retainer 130A. A cylindrical pin 174 is aligned with and inserted into the mutually aligned holes 142A and 166 to couple tool 160 to retainer 130A. A clevis pin 176 or other compatible device may be installed to secure pin 174.

To facilitate the removal of valve cover retainer 130A, a reaction tube 180 is axially aligned and inserted within bore 130B of adjacent valve cover retainer 130B. A pair of through-holes 186 (FIG. 5) in tube 180 is aligned with a pair of though-holes 142B in retainer 130B. Another cylindrical pin 174 is aligned with and inserted into the mutually aligned holes 186 and 142B to couple reaction tube 180 to retainer 130B. A second clevis pin 176 or other compatible device may be installed to secure pin 174.

Figure 8:
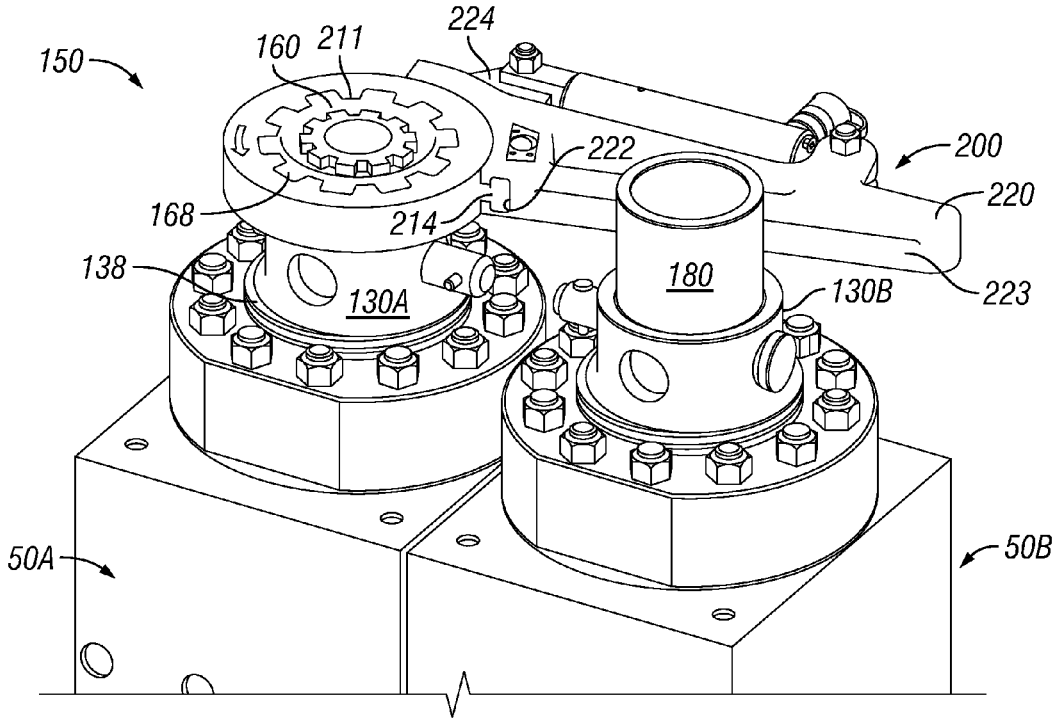
FIG. 8 is a perspective view similar to FIG. 7 and with a wrench used in accordance with principles disclosed herein.

Referring now to FIG. 8, prior to operation, wrench 200 is positioned so that internal splines 211 of wrench head 202 mate with external splines 168 of torque transfer tool 160. At the same time, arm 220 is positioned and disposed against reaction tube 180 with bearing surface 223 engaging reaction tube 180. Hydraulic cylinder 230 is positioned away from reaction tube 180. When hydraulic pressure is applied, hydraulic cylinder 230 extends, exerting torque on arm 224, causing arm 224 and annular head 202 to rotate relative to reaction arm 220 (counterclockwise in the arrangement shown in FIG. 8). The hydraulic pressure applied to the wrench 200 may be selected according to the manufacturer's specifications for the specific pump model, based upon the pressure vessel rating, valves, sealing arrangement, and other component specifications.

With bearing surface 223 of reaction arm 220 held against reaction tube 180, the torque applied to annular head 202 is transferred to tool 160 that is gripped within splined teeth 211. Due to the presence of pin 174, valve cover retainer 130A rotates along with the torque transfer tool 160. Each extension or forward stroke of hydraulic cylinder 230 rotates head 202 and retainer 130A approximately ninety degrees. To perform another forward stroke, wrench 200 is removed from engagement with torque transfer tool 160, hydraulic pressure is released through fitting 232, cylinder 230 is retracted by its internal spring, and wrench 200 is then reinstalled on torque transfer tool 160. Cylinder 230 is again pressurized to accomplish the next forward stroke. Continued rotation of tool 160 eventually removes the retainer 130A from the flange 120 to allow removal of valve cover 105 and valve 70 or 370 contained within the flow control module 50.

As an alternative to employing wrench 200 to remove completely retainer 130A, the wrench 200 may be used only for the initial loosening of the retainer 130A. After loosening, rig personnel may remove the wrench 200 and manually rotate and remove the retainer 130A. Prior to removal of retainer 130A, the above-described loosening process may be repeated for retainer 130B and for any other retainers 130 by alternating the placement of the torque transfer tool 160 and reaction tube 120. After each retainer 130 is loosened, rig personnel may manually rotate and remove each one.

After the servicing of the valves, the retainers 130, valve covers 105, and valves 70 or 370 may be reinstalled by reversing the removal process described above. Referring again to FIG. 8, installation of the retainers 130 may be started by the manual placement and rotation of the retainers 130 by rig personnel. The final tightening of the retainers 130 may then be performed using wrench 200. Wrench 200 can be inverted from its position shown in FIG. 8 to change the direction of rotation of head 202 and hence to tighten retainer 130, 130A. When wrench 200 is inverted, bearing surface 223 on wrench reaction arm 220 contacts the opposite side of reaction tube 180 as compared to what is shown in FIG. 8. Changing the orientation of wrench 200 in this manner changes from the removal mode to the installation mode because threads 138 of retainer 130 are caused to turn in the opposite direction from the removal operation.

Figure 9:
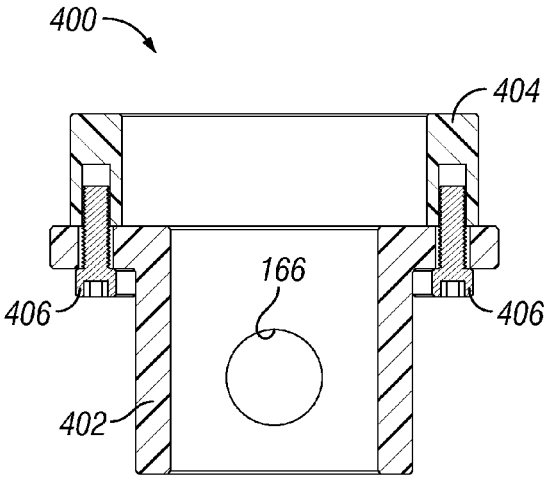
FIG. 9 is a cross-sectional view of a second embodiment of a torque transfer tool for removing and installing components of a valve cover assembly.
Figure 10:
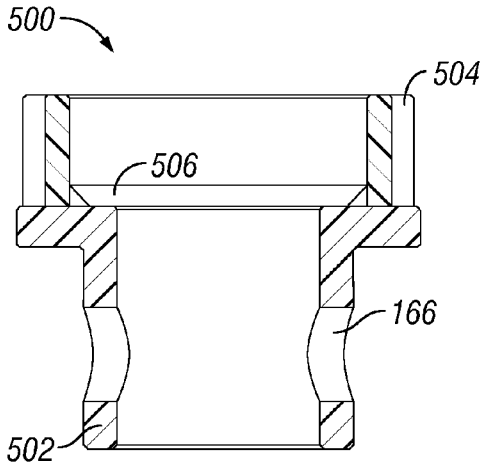
FIG. 10 is a cross-sectional view of a third embodiment of the torque transfer tool for removing and installing components of a valve cover assembly.

FIGS. 9 and 10 show alternative torque transfer tools. In FIG. 9, the torque transfer tool 400 includes a generally tubular body 402, which has at least one pair of aligned through-holes 166 to receive a pin 174, and includes a spline portion 404. Like end 162 of torque-transfer tool 160 described with reference to FIG. 4, spline portion 404 includes radially and axially-extending splines circumferentially-disposed about its outer surface for engagement with corresponding splines 211 of wrench head 202. In this embodiment, spline portion 404 is secured to the cylindrical body 402 by bolts 406, which may be axially aligned and circumferentially arranged around the cylindrical body 402. The arrangement shown in FIG. 9 allows the spline portion 404 to be manufactured separately from and thereafter coupled to the cylindrical body 402, which may reduce manufacturing costs relative to manufacturing the entire torque transfer tool as a single component.

In FIG. 10, a torque transfer tool 500 includes a generally tubular body 502, which has at least one pair of aligned through-holes 166 to receive a pin, and includes a spline portion 504. Spline portion 504 is secured to the cylindrical body 502 by a weld applied at chamfer 506. As with the torque transfer tool shown in FIG. 9, the arrangement shown in FIG. 10 allows the spline portion 504 to be manufactured separately from the cylindrical body 502 to simplify the manufacturing process.

The methods and apparatus described above allow for a wrench 200 to be used for the installation and removal of components of valve cover assemblies 100 by first removing the valve cover retainers 130. The present disclosure provides the capability for using a single wrench 200, and torque transfer tool 160 to remove each valve cover retainer 130 and thereby permit access to the accompanying valve cover 105 and valve 70 or 370 for removal and for installation.

Torque transfer tools 160, 400 and 500 have been described above as including a splined surface for engaging a splined portion of a wrench. It is to be understood that other tool-engaging surfaces may be employed other than splined surfaces thus far described. For example, the top portion of torque transfer tools 160, 400 and 500 could instead have square, hexagonal, or other multi-faceted surfaces for receiving a similarly-configured wrench head. While multi-faceted surfaces, which, as the term is used herein, shall include splined surfaces, are particularly advantageous to transfer torque and avoid the wrench slipping from the tool-engaging surface of the torque transfer tool, torque transfer tool 160, 400, 500 may have other configurations as well for the tool-engaging surface. Wrench 200 could be similarly modified.

Figure 11:
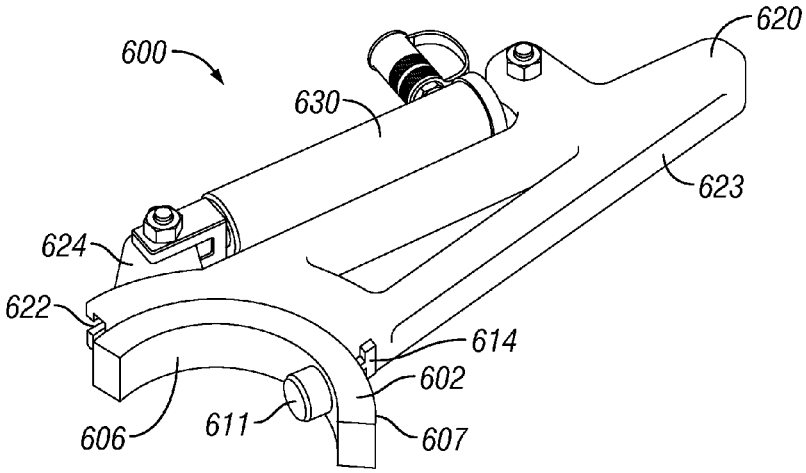
FIG. 11 is a perspective view of a second embodiment of a wrench for removing and installing components of a valve cover assembly.

FIG. 11 shows further apparatus for removing a valve cover retainer 130 and permitting the subsequent access to and removal of valve cover 105 and valve 70 or 370. In this embodiment, a wrench 600 is disclosed that is similar but not identical to wrench 200 previously described. Wrench 600 includes a reaction arm 620 and a hydraulic cylinder 630, like the previously-described wrench 200. However, unlike wrench 200, wrench 600 includes a rotating spanner section 602 at one end of arm 620 in place of a rotating annular head, like head 202. Spanner section 602 is shaped as an arc that is less than a full circle, and, in some embodiments, is not greater than 180 degrees. In the exemplary embodiment shown in FIG. 11, spanner section 602 is exemplified as being less than 180 degrees. Spanner section 602 includes a curved, outer surface 607, curved, inner surface 606, and a protrusion 611 extending radially inwardly from curved, inner surface 606. Curved, inner surface 606 has a radius of curvature that substantially matches the outer diameter of valve cover retainer 130. The protrusion 611 is sized and shaped so as to fit within the through-holes 142 of retainers 130. In this embodiment, protrusion 611 is generally shaped as a cylinder. Spanner section 602 also includes an arcuate rail 614, generally T-shaped in cross-section, and a rotatable arm 624, both fixed to and extending around portions of the circumference of spanner section 602. Rotatable arm 624 extends radially away from spanner section 602 and may be separate from or integrated with a portion of T-shaped rail 614. T-shaped rail 614 extends radially away from outer surface 607 of spanner section 602 and slidingly engages the inner surface of an arcuate T-slot 622 in reaction arm 620. Reaction arm 620 further includes bearing surface 623.

Although in this embodiment, spanner section 602 and reaction arm 620 are coupled by rail 614 with a T-shaped cross-section slidingly engaging a corresponding T-slot 622, another interlinkable, slidingly engagable coupling having a different cross-section could be used. For example, the cross-section might be L-shaped or the shape of a truncated triangle. The truncated triangle shape could be similar in some ways to a dovetail-shaped extension used in the field of carpentry to make joints. That is, rail 614 is configured to have a cross-sectioned profile that changes in shape in the direction radially outward from outer surface 607. Arcuate slot 622 is formed to have a corresponding shape. The irregular, changing cross-sectional profile allows the slot 622 to capture and retain rail 614.

Figure 12:
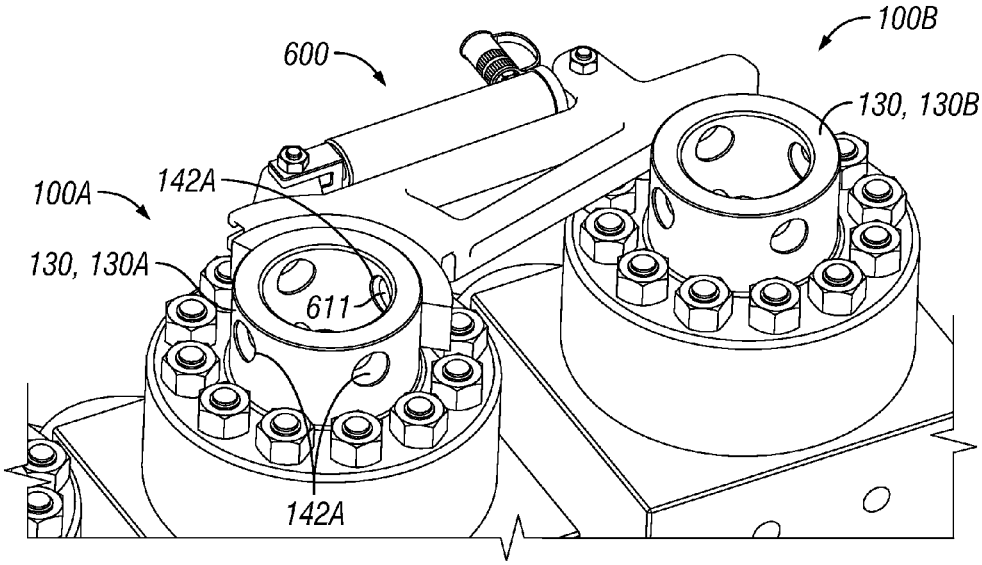
FIG. 12 is a perspective view of a fluid suction module of a reciprocating pump with a valve cover assembly being accessed with the wrench shown in FIG. 11 in accordance with the principles disclosed herein.

Referring now to FIG. 12, to remove retainer 130A using wrench 600, the protrusion 611 is inserted into one of the through-holes 142A of the retainer 130A with the inner surface 606 of the spanner section 602 engaging the outer surface of retainer 130A. Hydraulic pressure is then provided to the hydraulic cylinder 630 to cause reaction arm 620 to act against the adjacent retainer 130B and apply torque to retainer 130A. After one retainer 130 is loosened, wrench 600 may then be repositioned to loosen each of the other retainers 130. After each retainer 130 is loosened, service personnel may manually rotate and remove completely each of the retainers 130. As thus explained, wrench 600 can transfer the required torque directly to retainer 130, without the need for employing a torque transfer tool like tools 160, 400 or 500 previously described. Likewise, the use of a reaction tube 180 may be omitted in the situation where the retainer 130 of an adjacent valve cover assembly 100 extends high enough so as to serve as the support for the reaction arm 620.

The installation process for the retainers 130 is the reverse of the removal process, with final tightening of the retainers 130 carried out by wrench 600. To tighten retainers 130, wrench 600 is inverted to reverse the direction of the rotation of spanner section 602 and a retainer 130A. When inverted, bearing surface 623 of reaction arm 620 contacts the opposite side of the neighboring retainer 130B as compared to what is shown in FIG. 12. Changing the orientation of wrench 600 in this manner changes from the removal mode to the installation mode because threads 138 of retainer 130A are caused to turn in the opposite direction from the removal operation.

The apparatus and methods disclosed to this point have been described with respect to using reaction tube 180 to act as a support for the reaction arm of wrenches 200, 600 to bear against. However, it is to be understood that other available structure can be employed as a support for the reaction arm 220, 620 of wrenches 200, 600, respectively. As an example, in some pumps, the extending tubular retainer 130 of a valve cover assembly 100 that is adjacent to the one being removed may itself extend high enough for the reaction arm of the wrench to act against without a reaction tube 180 having to be inserted. Such an example is shown in FIG. 12. As shown, the bearing surface 623 of reaction arm 620 bears directly against retainer 130B of the valve cover assembly 100B that is adjacent to the assembly being removed via the removal of retainer 130A.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. Apparatus for removing and installing components of a first valve cover assembly having an extending tubular portion with transverse throughbores, the system comprising:

a first tool comprising:

a generally cylindrical body adapted to mate with the extending portion of the first valve cover assembly;

a multi-faceted segment on said body adapted to receive a torque-supplying wrench;

a pair of aligned holes in said body, said holes adapted to align with the throughbores in the extending portion of the first valve cover assembly; and a first pin member disposed through said aligned holes of said body and the transverse throughbores in the first valve cover assembly.

2. The apparatus of claim 1 further comprising a wrench, the wrench comprising;

an arm;

a head coupled to said arm and adapted for rotation with respect to said arm, said head including a multi-faceted portion adapted to engage said multi-faceted segment of said first tool; and a hydraulic cylinder coupled between said head and said arm and adapted to rotate said head upon actuation of said cylinder.

3. The apparatus of claim 2 further comprising:

a reaction tube comprising:

a generally cylindrical body adapted to mate with the extending portion of a second valve cover assembly adjacent to said first valve cover assembly;

a pair of aligned holes in said reaction tube body, said holes adapted to align with the throughbores in the extending portion of the second valve cover assembly; and a second pin member adapted to be disposed through said aligned holes of said reaction tube and the transverse throughbores in the second valve cover assembly.

4. The apparatus of claim 2 wherein said multi-faceted segment of said tool body comprises a plurality of splines, and wherein said multi-faceted portions of said wrench comprises a plurality of correspondingly sized and arranged splines to mate with said splines of said tool body.

5. The apparatus of claim 2, wherein said head of said wrench comprises:

an arcuate rail portion extending radially outward and having a cross-sectional profile that changes in shape as it extends away from said head, making the rail interlinkable; and wherein said arm comprises a complementary arcuate slot for capturing and slidingly receiving said rail portion.

6. The apparatus of claim 5 wherein said arcuate rail portion comprises a generally T-shaped cross-section.

7. The apparatus of claim 5, further comprising an arm portion coupled to said rail portion and extending radially away from said head, wherein said cylinder assembly couples to said arm portion.

8. The apparatus of claim 1 wherein said multi-faceted segment comprises a plurality of splines.

9. The apparatus of claim 1 wherein said first tool further comprises a generally tubular base portion, an upper splined portion, and a plurality of threaded fasteners coupling together said base portion and said splined portion, wherein said pair of aligned holes are formed in said base portion.

10. The apparatus of claim 1 wherein said first tool further comprises a generally tubular base portion welded to an upper splined portion, wherein said pair of aligned holes is formed in said base portion.

11. Apparatus for removing components of a valve cover assembly, comprising:

a torque transfer tool comprising a male spline section coupled to a cylindrical body that is adapted to fit within a component of a first valve cover assembly to be removed, wherein the cylindrical body comprises a through-hole perpendicular to the longitudinal axis of the cylindrical body; and a wrench comprising an arm, a female spline section coupled to said arm and adapted to receive the male spline section of the torque transfer tool, and a hydraulic cylinder coupled to said arm and adapted to rotate said female spline section when it is engaging said male spline section.

12. The apparatus of claim 11 further comprising:

a reaction tube having a cylindrical body substantially the same diameter as the cylindrical body of said torque transfer tool, and further having a through-hole perpendicular to the longitudinal axis of said cylindrical body of said reaction tube; and wherein said arm of said wrench is engaged against said reaction tube with said female splined section of said wrench coupled to said male splined section of said torque transfer tool.

13. The apparatus of claim 11 wherein said female splined section further comprises:

an arcuate rail portion extending radially outward and having a cross-sectional profile that changes in shape as it extends away from said female splined section, making the rail interlinkable; and wherein said wrench arm comprises a complementary arcuate slot for capturing and slidingly receiving said rail portion.

14. The apparatus of claim 13 wherein said arcuate rail portion comprises a generally T-shaped cross-section.

15. The apparatus of claim 13, wherein said wrench further comprises an arm portion coupled to said rail portion and wherein said hydraulic cylinder couples to said arm.

16. A wrench for rotating a retaining member having at least one receiving bore, the wrench comprising:

an elongate arm;

a head for engaging the retaining member, wherein the head is rotatably coupled to a first end of said arm, and wherein the head comprises:

an arcuate segment having a non-facetted inner surface and an arcuate length not greater than 180 degrees; and at least one protrusion extending radially inward from said inner surface, wherein the at least one protrusion is configured to engage the receiving bore of the retaining member; and a hydraulic cylinder coupled to said head and to a portion of said arm that is spaced apart from said head, said cylinder adapted to rotate said head upon actuation.

17. The wrench of claim 16 further comprising:

a rail portion extending radially outward from said arcuate segment and having a T-shaped cross section; and a receiving slot in said arm for slidingly receiving said rail portion.

18. The wrench of claim 17 further comprising an arm portion coupled to said rail portion and wherein said cylinder assembly couples to said arm.

19. The wrench of claim 18 wherein said cylinder assembly is pivotable relative to said arm.

20. The wrench of claim 16 wherein the retaining member has a cylindrical outer surface; and wherein the head of the wrench is configured to engage up to a 180 degree contiguous region of the outer surface of the retaining member.

* * * * *